US007065801B1

(12) United States Patent
Klepfer

(10) Patent No.: US 7,065,801 B1
(45) Date of Patent: Jun. 27, 2006

(54) PIVOT MOUNT TOILET VENTILATION SEAT

(76) Inventor: Thomas W. Klepfer, 6331 West 200 South, Crawfordsville, IN (US) 47933

( * ) Notice: Subject to any disclaimer, the term of this patent is extended or adjusted under 35 U.S.C. 154(b) by 0 days.

(21) Appl. No.: 11/079,489

(22) Filed: Mar. 15, 2005

(51) Int. Cl.
*A47K 13/00* (2006.01)
*E03D 9/04* (2006.01)

(52) U.S. Cl. ..... 4/217; 4/213

(58) Field of Classification Search ..... 4/213, 4/216, 217, 352
See application file for complete search history.

(56) References Cited

U.S. PATENT DOCUMENTS 5,898,951 A 5/1999 Rakoz
6,237,163 B1 * 5/2001 Guzzo et al. ..... 4/213
6,519,786 B1 2/2003 Francis
6,567,994 B1 5/2003 Spurr et al.
6,615,410 B1 * 9/2003 Gurrola ..... 4/213
6,775,853 B1 * 8/2004 Szekely ..... 4/217

* cited by examiner

*Primary Examiner*—Tuan Nguyen
(74) *Attorney, Agent, or Firm*—Crossley Patent Law; Mark A. Crossley

(57) ABSTRACT

A toilet ventilation system utilizing a typical toilet and existing restroom ventilation fan and fan outlets, the system comprising a pivotally mounted vented seat for replacing a typical toilet seat, the vented seat having typically sized and located mounting plates, the vented seat comprising a plurality of inlet apertures communicating with an outlet pathway for gasses, the outlet having a sealed pivot connection sharing a common axis with the seat hinge, whereby the seat pivots and retains the seal against vented gas loss.

19 Claims, 4 Drawing Sheets

PIVOT MOUNT TOILET VENTILATION SEAT

BACKGROUND OF THE INVENTION

A need has been established and solutions pursued for the ventilation of unpleasant odors from restroom facilities. The pursuits typically involve forced air ventilation from ceilings and upper walls. Other more recent designs address toilet seat ventilation. A typical problem is the connection between a pivoting toilet seat and a hose and mechanism for ventilation. The present invention successfully addresses the problems of restroom ventilation with a new approach that incorporates as much existing hardware as possible.

FIELD OF THE INVENTION

The present invention relates to restroom ventilation and more specifically to pivot mount toilet ventilation system that extensively utilizes currently existing hardware of most restrooms to aid in solving ventilation problems.

SUMMARY OF THE INVENTION

The general purpose of the pivot mount toilet ventilation system, described subsequently in greater detail, is to provide a pivot mount toilet ventilation system which has many novel features that result in an improved toilet ventilation system which is not anticipated, rendered obvious, suggested, or even implied by prior art, either alone or in combination thereof.

The pivot mount toilet ventilation system utilizes an existing toilet for mounting a replacement seat, after removing the existing seat. Mounting points are identical, with typical seat lid mounting points and hardware also applicable for the toilet seat lid. The shape of the vented seat closely resembles that of the typical seat. Examples of the invention vary with some examples being thicker for additional strength. The oval seat is also offered in examples which are closed or open in the front of the oval, as open seats are sometimes preferred or required. A plurality of vent apertures further comprises the vented seat. In one example, the apertures face medially from the oval, toward the center of the toilet. In yet another example, the apertures face downwardly. Apertures are numerous such that they easily acquire air to be vented without noisy operation.

The vented seat of the invention is injection molded, thereby offering more efficiently produced seats with the proper apertures and vent channel within. Injection molding also offers strength of design that might otherwise be lost with the vented seat. Seat examples vary to suit various existing restroom needs.

One example of the invention comprises a pressure switch for activating a connection to engage an existing fan. The switch mounts beneath the vented seat, between the seat and the existing toilet bowl. Another example features a timer for abbreviating the time that an existing ventilation fan runs. Each example offers the potential for saving operating electricity and thereby operational costs.

The vented seat apertures collect gasses from the toilet bowl area. The apertures communicate with a vent channel comprising a substantial internal area of the vented seat. The gasses pass from the seat into a collection manifold at the rear of the seat. The collection manifold communicates with an angle channel. The importance of the angle channel is that it provides laminar flow of the gasses. Laminar gas flow provides for greater gas collection and exit from the invention. Laminar flow also helps prevent moisture condensation on the walls of gas flow devices of the invention. An outlet tube communicates directly with the angle channel. The outlet tube further comprises an outlet orifice. The outlet orifice is bordered on either side by o-rings. The o-rings are externally fitted to the outlet tube. A slanted downpipe is partially comprised of a sleeve section. The sleeve section surrounds the o-rings and orifice of the outlet tube. The distal end of the outlet tube is capped. The sleeve section, outlet tube, o-rings, and orifice form a sealed pivot connection. The sealed pivot connection allows for the vented seat to pivot without leaking vented gasses. The factor critical to a functional seal remains the coaxial pivoting action of the hinge and the outlet tube. Coaxial pivot along the same axis centerline provides for maintaining the seal.

The slanted downpipe provides for gas exit from the sealed pivot connection without colliding with a typical toilet reservoir. The slanted downpipe is also more esthetically pleasing than would be more visibly arranged gas outlets. The slanted downpipe joins an outlet tube for exit of gasses.

The gasses are channeled toward a wall or ceiling, the direction chosen being determined by access to existing fan ventilation or fan pipe ventilation. As most restrooms have existing fan ventilation, and as most fan ventilation systems are well established in design and function, rather than replace those existing systems, the present invention utilizes them. This offers a more economical solution to toilet ventilation.

Thus has been broadly outlined the more important features of the toilet ventilation system so that the detailed description thereof that follows may be better understood and in order that the present contribution to the art may be better appreciated.

Numerous objects, features and advantages of the pivot mount toilet ventilation system will be readily apparent to those of ordinary skill in the art upon reading the following detailed description of presently preferred, but nonetheless illustrative, examples of the pivot mount toilet ventilation system when taken in conjunction with the accompanying drawings. In this respect, before explaining the current examples of the pivot mount toilet ventilation system in detail, it is to be understood that the invention is not limited in its application to the details of construction and arrangements of the components set forth in the following description or illustration.

The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the pivot mount toilet ventilation system. It is therefore important that the claims be regarded as including such equivalent constructions insofar as they do not depart from the spirit and scope of the present invention.

Objects of the pivot mount toilet ventilation system, along with various novel features that characterize the invention are particularly pointed out in the claims forming a part of this disclosure. For better understanding of the toilet ventilation system, its operating advantages and specific objects attained by its uses, refer to the accompanying drawings and description.

DETAILED DESCRIPTION OF THE DRAWINGS

With reference now to the drawings, and in particular FIGS. 1 through 4 thereof, example of the pivot mounted toilet ventilation system employing the principles and concepts of the present invention and generally designated by the reference number 10 will be described.

Figure 1:
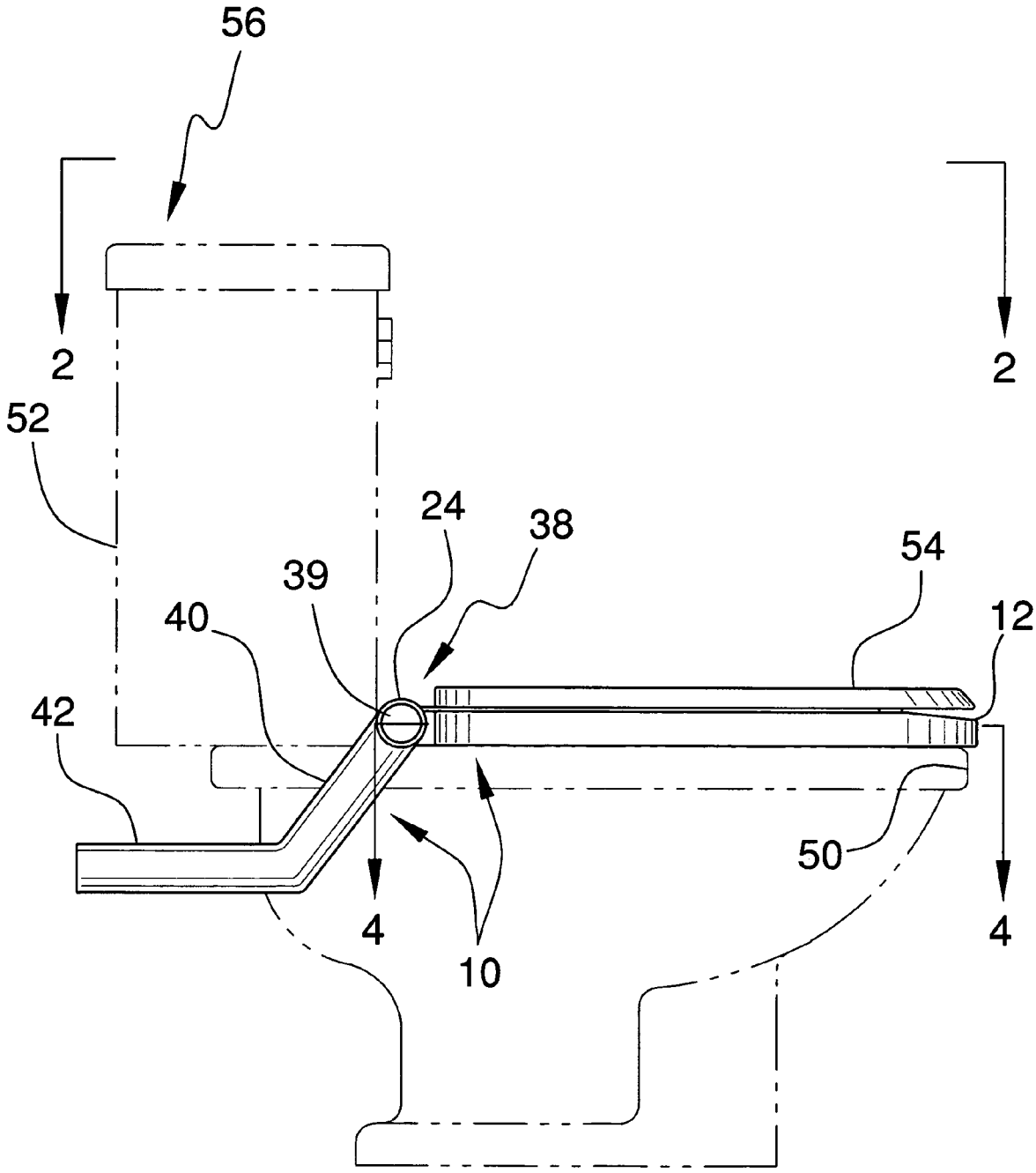
FIG. 1 is a side elevation of the invention installed on a typical toilet.
Figure 3:
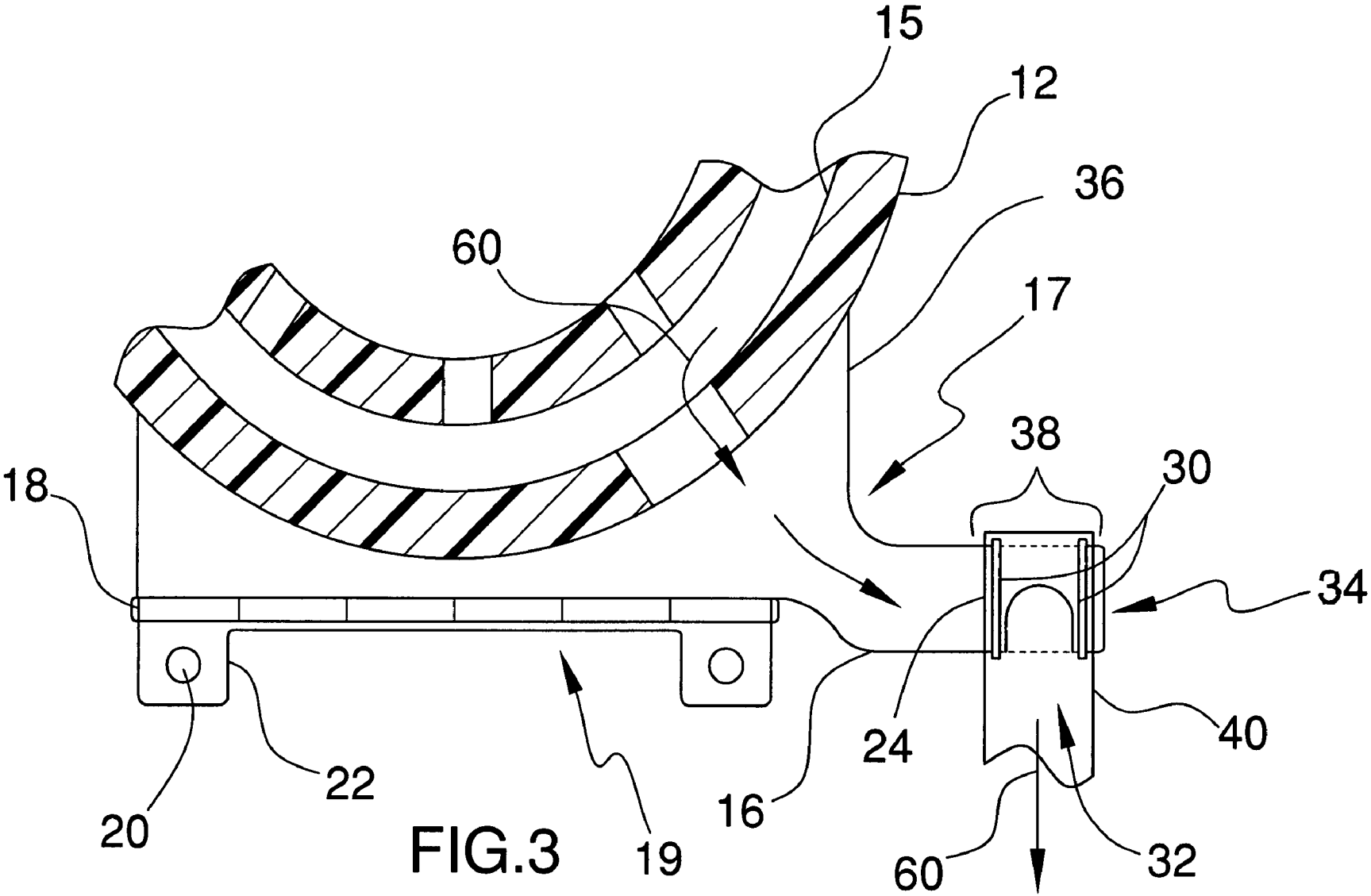
FIG. 3 is a cross sectional view of the rear of the invention, with detail of the sealed pivot connection.

Referring to FIG. 1, the invention 10 is fitted atop a typical toilet bowl 50 of a typical toilet 56. The typical seat lid 54 is pivotally affixed (not shown) to moveably rest upon vented seat 12. The sealed pivot connection partially comprises sleeve section 24 of slanted downpipe 40. Slanted downpipe 40 connects to outlet pipe 42. The cap 39 seals the end of the outlet tube 16 (FIG. 3). The slanted downpipe 40 prevents collision with the reservoir 52 of the toilet 56.

Figure 2:
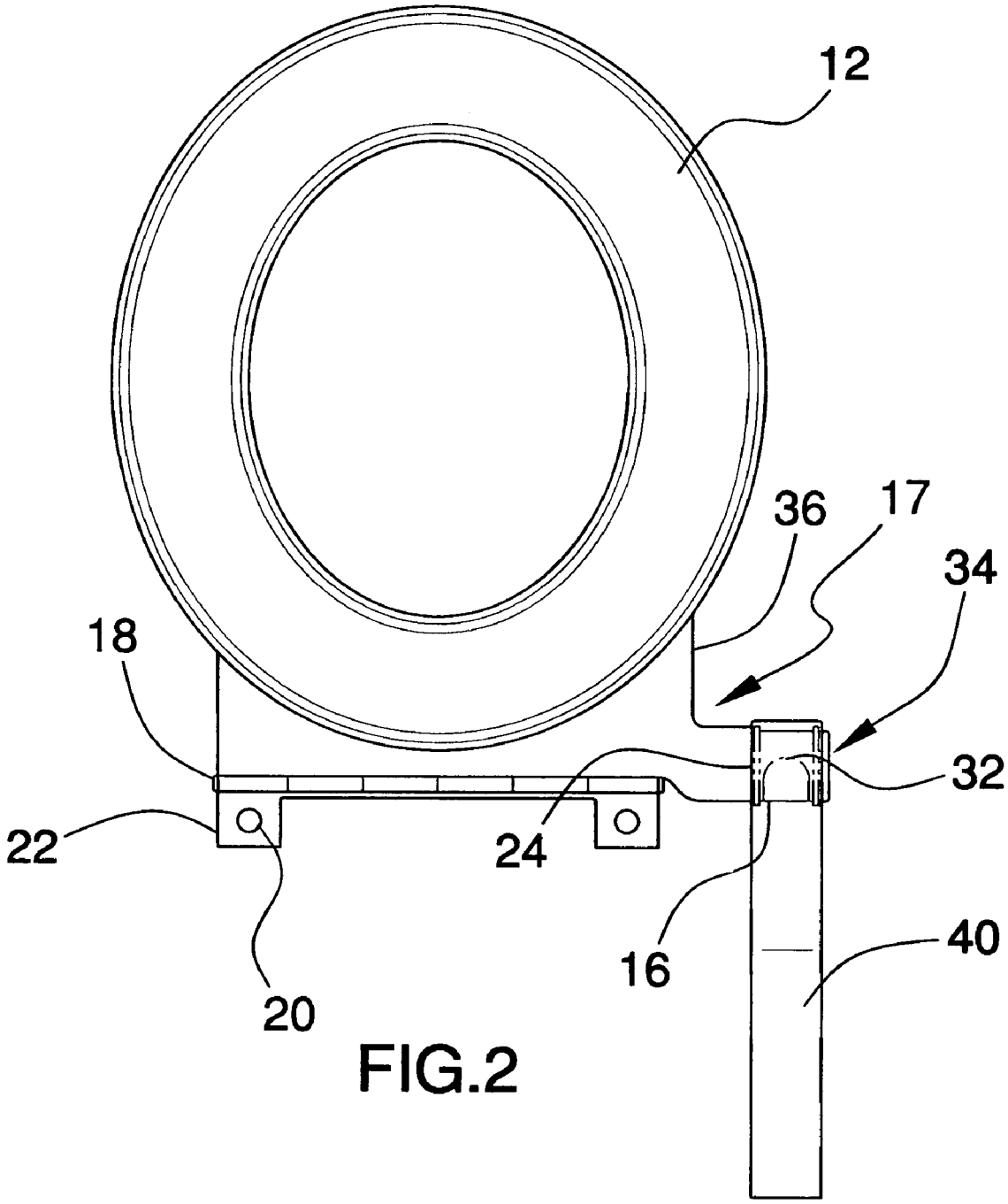
FIG. 2 is a top plan view of the invention.

Referring to FIG. 2, the spaced apart mounting plates 22 are disposed in the pattern and location of a typical toilet seat's mounts (not shown). Mounting holes 20 accommodate typical toilet mounting bolts (not shown). The collection manifold 36 conveys gasses (not shown) to the angle channel 17.

The vented seat 12 is rearwardly bounded by the hinge 18 and mounting plates 22. The angle channel 17 provides for laminar flow of gasses from the collection manifold 36 to the outlet tube 16. The outlet tube 16 exits the toilet 56 horizontally. The outlet tube 16 and the hinge 18 operate along an identical axis. This coaxial operation allows for the vented seat 12 to pivot without breaking the seal provided by the sealed pivot connection 38. The outlet tube 16 is sealed by the cap 39 at the distal end of the outlet tube 16. An outlet orifice 32 is proximal to the distal end of the outlet tube 16. The outlet orifice 32 angles slightly downward to match the angle of the slanted downpipe 40. O-rings 30 are disposed on either side of the outlet tube 16. O-rings 30 are fitted around the outlet tube 16 within grooves (not shown). A sleeve section 24 of the hollow slanted downpipe 40 surrounds the distal end of the outlet tube 16. The sleeve section 24 is thereby sealed around the outlet tube 16 by the o-rings 30. The sleeve section 24 seamlessly joins the slanted downpipe 40.

Referring to FIG. 3, the vent channel 15 of the seat 12 flows gasses into the collection manifold 36. The collection manifold 36 is rearwardly bounded by the hinge 18. The hinge 18 is attached to the mount 19. Mounting plates 22 are a part of the mount 19. The collection manifold 36 is disposed at the rear of the seat 12. The angle channel 17 provides for laminar gas flow 60 into the outlet tube 16. The distal end of the outlet tube 16 is partially comprised of the outlet orifice 32. The sleeve section 24 of the slanted downpipe 40 substantially covers the distal end of the outlet tube 16. An o-ring is fitted on either side of the outlet orifice 32. O-rings are fitted in grooves (not shown) of the outlet tube 16.

The sleeve section seals about the o-rings. Gas flow 60 exits the outlet orifice 32 into the slanted downpipe 40. The distal end of the outlet tube 16, the outlet orifice 32, the sleeve section 24, the outlet tube grooves, and the o-rings 30 comprise the sealed pivot connection 38. Gas flow 60 is conveyed from the vented seat 12 to the slanted downpipe 60 without escape. The axis centerline 34 of the sealed pivot connection 38 is coaxial with the hinge 18. The coaxial arrangement provides for pivoting of the seat 12 without gas flow 60 loss.

Figure 4:
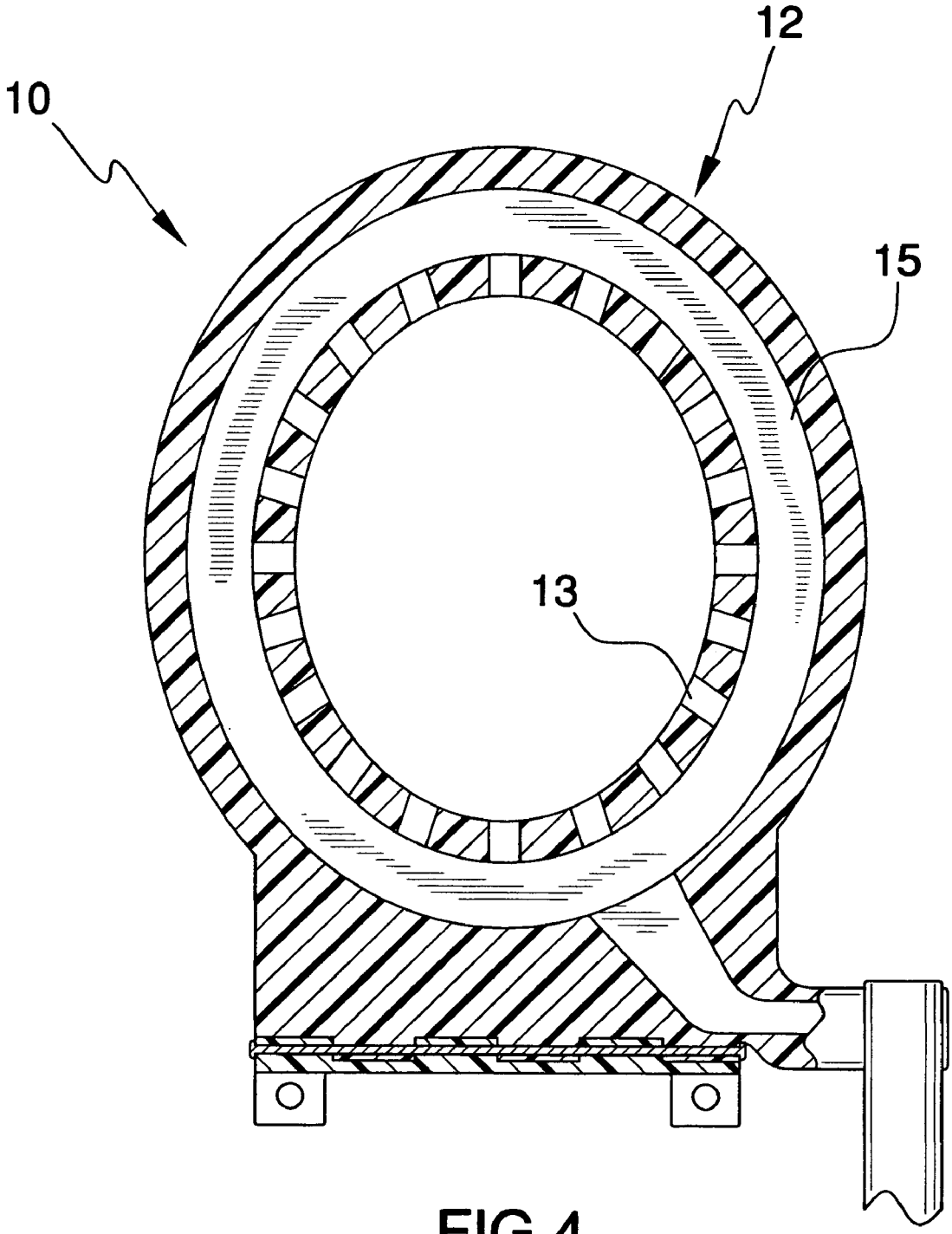
FIG. 4 is a cross sectional top view of the vented toilet seat and medially disposed inlet apertures.

Referring to FIG. 4, the seat 12 is substantially comprised internally of the vent channel 15. Inlet apertures 13 are disposed to face medially from the seat 12 interior. The inlet apertures 13 communicate directly with the vent channel 15.

With respect to the above description then, it is to be realized that the optimum dimensional relationships for the parts of the pivot mount toilet ventilation system, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A toilet ventilation system for use with a typical toilet and existing restroom ventilation fan and fan outlets, the system comprising:

a vented seat;

a plurality of inlet apertures within the seat;

a vent channel within a substantial portion of the seat, the vent channel communicating with the inlet apertures;

a collection manifold at a rear of the seat, the collection manifold communicating with the vent channel;

a hinge connecting the collection manifold to a seat mount, the hinge having a pivot axis;

an angle channel communicating with the manifold;

an outlet tube communicating with the angle channel, the outlet tube having a centerline coplanar to the hinge axis;

an outlet orifice within the outlet tube;

an outlet pipe, the outlet pipe for conveying gasses away from the toilet;

a sealed pivot connection connecting the outlet tube with outlet orifice to the outlet pipe, whereby the outlet pipe conveys gasses away from the toilet seat and to existing toilet ventilation.

2. The invention in claim 1 wherein a slanted downpipe connects between the sealed pivot connection and the outlet pipe.

3. The invention in claim 2 wherein the toilet seat comprises a full oval shape.

4. The invention in claim 3 wherein the seat is slightly elevated above the toilet bowl;

the apertures of the seat opening medially.

5. The invention in claim 3 wherein the seat is slightly elevated above the toilet bowl;

the apertures of the seat opening downwardly.

6. The invention in claim 2 wherein the toilet seat is a semi-oval with a separation in the front of the oval seat.

7. The invention in claim 6 wherein the seat is slightly elevated above the toilet bowl;

the apertures of the seat opening medially.

8. The invention in claim 4 wherein the seat is slightly elevated above the toilet bowl;

the apertures of the seat opening downwardly.

9. A toilet ventilation system for use with a typical toilet and existing restroom ventilation fan and fan outlets, the system comprising:

a vented seat;

a plurality of inlet apertures within the seat;

a vent channel within a substantial portion of the seat, the vent channel communicating with the inlet apertures;

a collection manifold at a rear of the seat, the collection manifold communicating with the vent channel;

a hinge connecting the collection manifold to a seat mount, the hinge having a pivot axis;

an angle channel communicating with the manifold;

an outlet tube communicating with the angle channel, the outlet tube having a centerline coplanar to the hinge axis, the outlet tube having a proximal end and a distal end;

a cap on the distal end of the outlet tube;

an outlet orifice within the outlet tube, the outlet orifice proximal to the cap;

a pair of spaced apart o-rings disposed on either side of the outlet orifice;

a sleeve section of an outlet pipe, the sleeve section pivotally surrounding the o-rings and outlet orifice, whereby the outlet pipe conveys gasses away from the toilet seat and to existing toilet ventilation.

10. The invention in claim 9 wherein the toilet seat comprises a full oval shape.

11. The invention in claim 10 wherein the seat is slightly elevated above the toilet bowl;

the apertures of the seat opening medially.

12. The invention in claim 10 wherein the seat is slightly elevated above the toilet bowl;

the apertures of the seat opening downwardly.

13. The invention in claim 9 wherein the toilet seat is a semi-oval with a separation in the front of the oval seat.

14. The invention in claim 13 wherein the seat is slightly elevated above the toilet bowl;

the apertures of the seat opening medially.

15. The invention in claim 13 wherein the seat is slightly elevated above the toilet bowl;

the apertures of the seat opening downwardly.

16. A toilet ventilation system for use with a typical toilet and existing restroom ventilation fan and fan outlets, the system comprising:

a vented seat, the seat slightly elevated above the toilet bowl;

a plurality of inlet apertures within the seat, the apertures of the seat opening downwardly;

a vent channel within a substantial portion of the seat, the vent channel communicating with the inlet apertures;

a collection manifold at a rear of the seat, the collection manifold communicating with the vent channel;

a hinge connecting the collection manifold to a seat mount, the hinge having a pivot axis;

an angle channel communicating with the manifold;

an outlet tube communicating with the angle channel, the outlet tube having a centerline coplanar to the hinge axis, the outlet tube having a proximal end and a distal end;

a cap on the distal end of the outlet tube;

an outlet orifice within the outlet tube, the outlet orifice proximal to the cap;

a pair of spaced apart o-rings disposed on either side of the outlet orifice;

a pair of grooves in the outlet tube, each groove receiving each o-ring;

a sleeve section of an outlet pipe, the sleeve section pivotally surrounding the o-rings and outlet orifice, whereby the outlet pipe conveys gasses away from the toilet seat and to existing toilet ventilation;

a downwardly facing pressure switch in the toilet seat, the pressure switch for signaling an existing restroom ventilation fan.

17. The invention in claim 16 wherein the pressure switch further comprises a timer for timed shutoff of the pressure switch signal to the existing ventilation fan.

18. The invention in claim 17 wherein the toilet seat comprises a full oval shape.

19. The invention in claim 17 wherein the toilet seat is a semi-oval with a separation in the front of the oval seat.

* * * * *